US007281845B2

(12) United States Patent
Hohenstein et al.

(10) Patent No.: US 7,281,845 B2
(45) Date of Patent: Oct. 16, 2007

(54) WATCHCASE ADAPTED FOR A REMOVABLE ORNAMENTAL TOP

(76) Inventors: William H. Hohenstein, P.O. Box 128, 9 Farm St., Canton, MD (US) 02021; Andrew Von Zadora-Gerlof, 828 5th Ave. 1st Flr, New York, NY (US) 10021

( * ) Notice: Subject to any disclaimer, the term of this patent is extended or adjusted under 35 U.S.C. 154(b) by 213 days.

(21) Appl. No.: 10/820,641

(22) Filed: Apr. 8, 2004

(65) Prior Publication Data

US 2005/0237863 A1 Oct. 27, 2005

(51) Int. Cl.
*G04B 19/00* (2006.01)
*G04B 19/20* (2006.01)

(52) U.S. Cl. ..... 368/281; 368/76; 368/77; 368/223; 368/234; 368/281; 368/285

(58) Field of Classification Search ..... 368/76, 368/77, 80, 223, 228, 276, 281, 285, 316–317, 368/234
See application file for complete search history.

(56) References Cited

U.S. PATENT DOCUMENTS

| | | | | |
|---|---|---|---|---|
| 2,036,046 A | | 3/1936 | Harrison | |
| 2,444,392 A | * | 6/1948 | Willens | 368/78 |
| 2,513,465 A | * | 7/1950 | Fisk | 368/21 |
| 2,757,508 A | | 8/1956 | Zanetti | |
| 4,393,558 A | | 7/1983 | Herwegh et al. | |

(Continued)

FOREIGN PATENT DOCUMENTS

| | | |
|---|---|---|
| CH | 666 979 G A3 | 9/1988 |
| DE | 89 13 993 | 2/1990 |
| EP | 0 654 717 A1 | 5/1995 |

OTHER PUBLICATIONS

Zapata, Janet, "The Art of Zadora (America's Fabergé)." The Vendome Press: New York (1999). Photos by David Behl.

*Primary Examiner*—Vit Miska
*Assistant Examiner*—Thanh S. Phan
(74) *Attorney, Agent, or Firm*—Elmore Patent Law Group, P.C.; Carolyn S. Elmore; Darlene A. Vanstone

(57) ABSTRACT

The invention relates to a watchcase comprising:

(a) a lower case characterized by a first annular recess for receiving an optically transparent cylinder and a timepiece support for receiving a timepiece mechanism;

(b) an upper case characterized by (i) on the bottom surface thereof, a second upper annular recess for receiving an optically transparent cylinder; (ii) on the upper surface thereof, a track for removably receiving and securing an ornamental top;

(c) an optically transparent cylinder placed in said first and second annular recesses and between the lower and upper cases wherein the lower case, upper case and optically transparent cylinder are fixedly connected.

The invention also relates to a watch that comprises the watchcase and a cylindrical timepiece, with or without one or more ornamental tops and watch bands.

The invention also relates to an ornamental top adapted to be worn on a watchcase wherein said ornamental top comprises (a) an upper surface adorned with an ornament; (b) a flange on the bottom surface, extending inwardly with respect to said watchcase from the upper surface of the watchcase; and (c) at least one bayonette extending further outwardly from said flange configured to removably engage in a track in said watchcase. In a preferred embodiment, the top comprises a sculpture, such as a jeweled sculpture of about one centimeter in height or more.

22 Claims, 4 Drawing Sheets

U.S. PATENT DOCUMENTS 4,430,004 A 2/1984 Nitschke
4,525,077 A 6/1985 Ketner
4,737,943 A 4/1988 Kienberger
4,817,064 A * 3/1989 Milles ..... 368/282
4,858,209 A 8/1989 Chaut
4,939,913 A 7/1990 Scungio et al.
4,985,877 A 1/1991 Namisato
5,412,625 A 5/1995 Duchek
5,640,372 A 6/1997 Thackara
5,694,378 A 12/1997 Totsuka
6,092,923 A 7/2000 Perrot
6,891,778 B1 * 5/2005 Hohenstein et al. ..... 368/76

* cited by examiner

WATCHCASE ADAPTED FOR A REMOVABLE ORNAMENTAL TOP

BACKGROUND OF THE INVENTION

Jewelry and ornamental wristwatches are well known. Wristwatches available on the markets can be generally divided into mechanical and electronic types. Appearance designs for wrist watches include jeweled watch faces and interchangeable watch faces. Wrist watches that can be viewed from the top and from the side have also been described. See U.S. Ser. No. 10/031,375, filed by Hohenstein et al. This wrist watch is characterized by a unique watch mechanism and dial suspension system that enables viewing from the side of the watch rather than the traditional topview and incorporates a special mechanism for attaching a removable ornament, such as a jeweled sculpture, on the top without the need for any mechanical tools or other fastening devices. However, such a watch has never been manufactured so that the sculpture could be easily removed and replaced by the customer. The inventors, therefore, endeavored to develop a device that can employ multiple, beautiful ornaments on a novel watch with a rotating conical band that incorporates the utility of a watch and the beauty and elegance of a miniature gemstone sculpture or other objects d'art.

SUMMARY OF THE INVENTION

The invention relates to a watchcase comprising:

(a) a lower case characterized by a first annular recess for receiving an optically transparent cylinder and a timepiece support for receiving a timepiece mechanism;

(b) an upper case characterized by (i) on the bottom surface thereof, a second upper annular recess for receiving an optically transparent cylinder; (ii) on the upper surface thereof, a track for receiving and securing an ornamental top;

(c) an optically transparent sapphire cylinder placed in said first and second annular recesses and between the lower and upper cases wherein the lower case, upper case and optically transparent cylinder are fixedly connected.

The invention also relates to a watch that comprises the watchcase and a cylindrical timepiece, with or without one or more ornamental tops and watch bands.

The invention also relates to an ornamental top adapted to be worn on a watchcase wherein said ornamental top comprises (a) an upper surface adorned with an ornament; (b) a flange on the bottom surface, extending inwardly with respect to said watchcase from the upper surface of the watchcase; and (c) at least one bayonette extending further outwardly from said flange configured to allow for the removal and engagement in a track in said watchcase. In a preferred embodiment, the top comprises a sculpture, such as a jeweled sculpture of about one to three centimeters in height.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
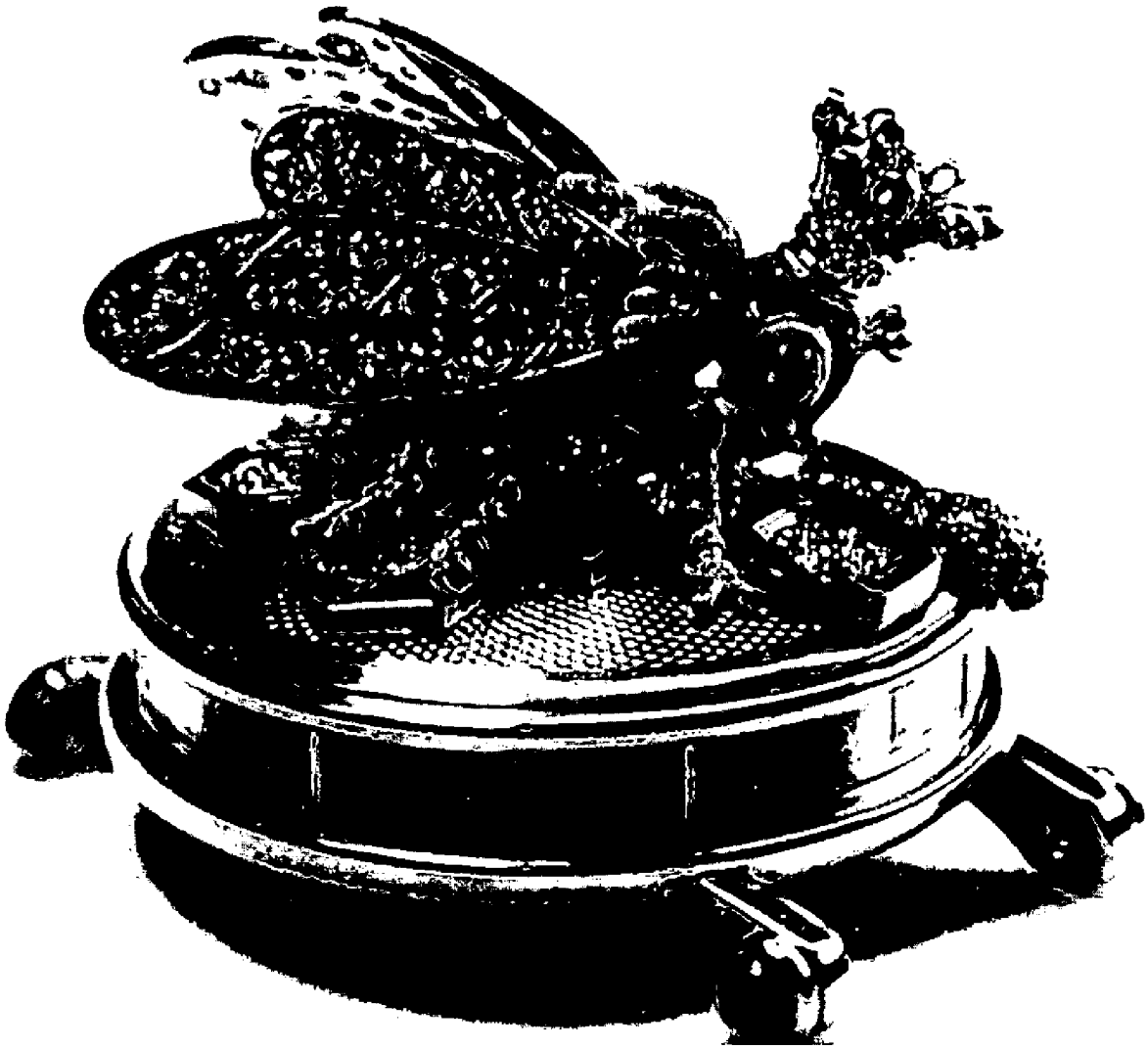
FIG. 1 is a perspective view of a watch according to the invention.

Turning to the figures, FIG. 1 shows a perspective view of a watch of the invention. The watchcase 10 comprises a lower case 11, an upper case, an ornamental top 13 adorned with an ornament or sculpture 14, an optically transparent sapphire cylinder 15 through which can be viewed a cylindrical band with time increments 17, screws 18 that attach the upper and lower cases; and a watchband attachment 19.

Figure 2B:
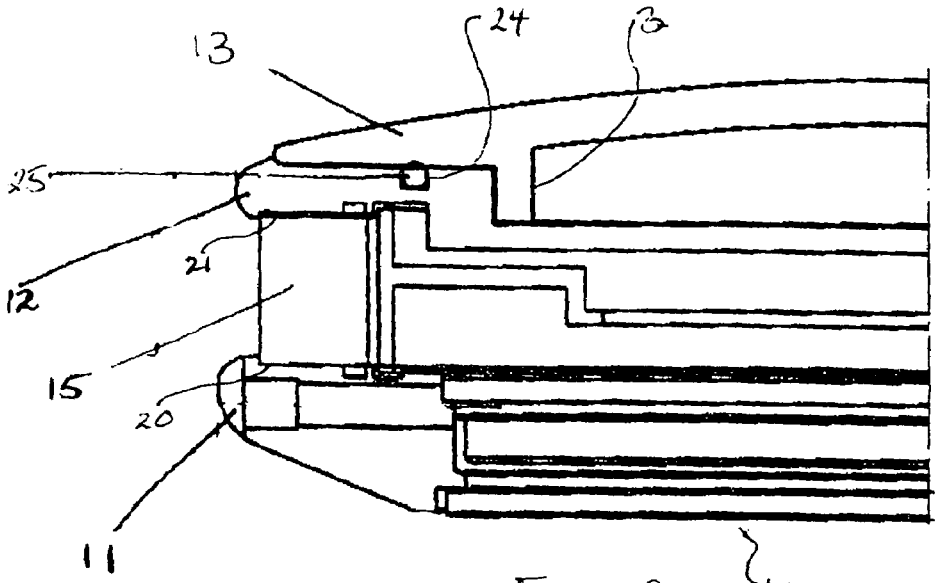
FIGS. 2A, 2B and 2C are cross sections of the watch at different locations.
Figure 2A:
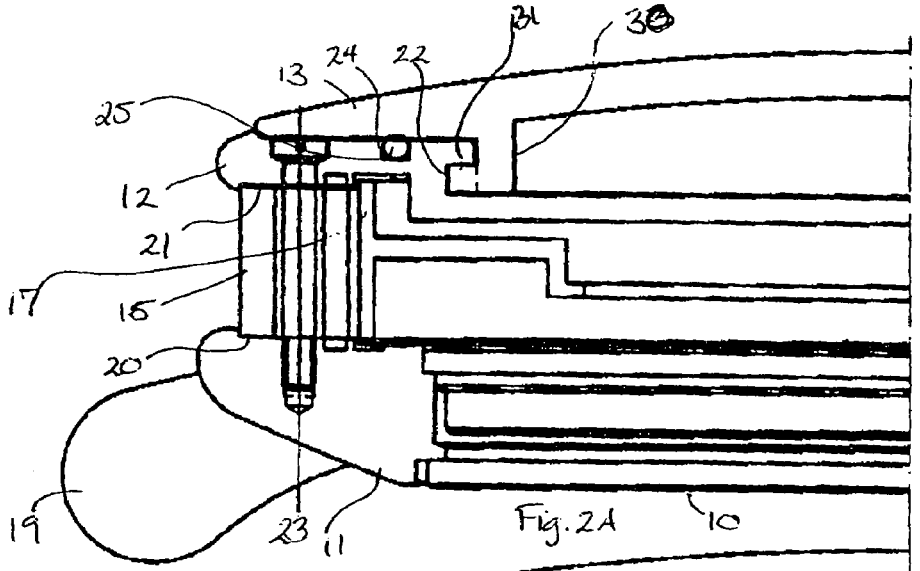
Figure 2C:
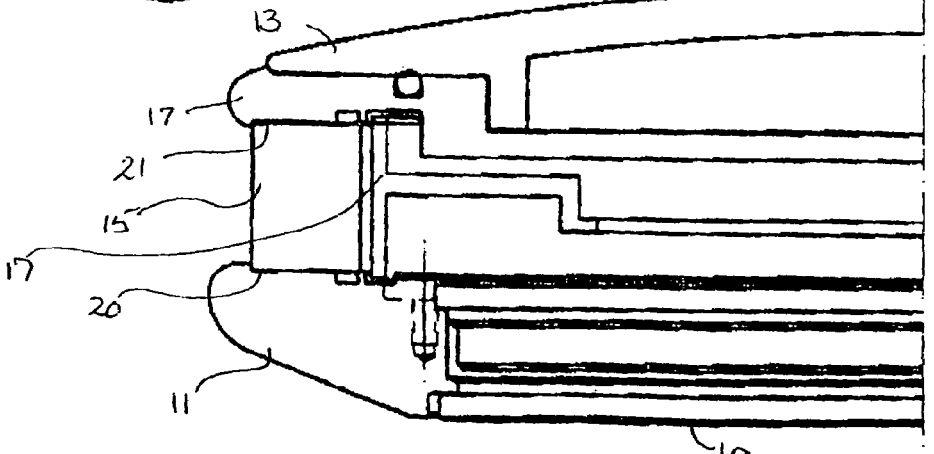

FIGS. 2A–2C are cross sections of the watch case with the ornamental top. All three figures employ consistent numbering of the elements. Turning to FIG. 2A, the watch case 10 comprises (a) a lower case 11 characterized by a first annular recess 20 for receiving an optically transparent cylinder 15 and a timepiece support for receiving a timepiece mechanism and timepiece mechanism (not shown) and an optionally transparent bottom surface, thereby permitting viewing of the timepiece mechanism;

(b) an upper case 12 characterized by (i) on the bottom surface thereof, a second upper annular recess 21 for receiving the optically transparent cylinder 15; (ii) on the upper surface thereof, a track 22 for removably receiving and securing an ornamental top 13;

(c) an optically transparent cylinder 15 placed in said first and second annular recesses, 20 and 21, respectively, and between the lower and upper cases wherein the lower case, upper case and optically transparent cylinder are fixedly connected by, for example, screws 23 or other suitable mechanism.

The track 22 is preferably disposed in a plane below, with respect to the watchcase, below the upper surface of the upper case. FIGS. 2B and 2C show that track 22 need not be contiguous. Rather, the track is preferably configured to guide the top 13 into place and rest when in the secured position. Thus, this track, or groove, need only be machined for the length of travel that the top will rotate. This configuration will be discussed in more detail below in connection with the figures showing the top view cross section of the watchcase.

Returning to FIG. 2A is the watchband attachment 19 which is attached to the lower case. Behind the optically transparent cylinder 15, which is preferably made of sapphire, a cylindrical band 17 having time increments is placed thereon such that the time increments can be viewed through the optically transparent cylinder.

The upper and lower cases and the optically transparent cylinder are preferably fixedly connected by at least one screw, preferably two, three, four, five, six, seven, eight or more screws. The screws can be placed internally, externally or within the optically transparent cylinder. In a preferred embodiment, the screws are placed in an annular configuration.

To further improve the stability and security of the ornamental top, the upper case 12, on the upper surface thereof, comprises a third annular recess 24 for receiving a compression ring 25 for frictionally securing said ornamental top thereon. The compression ring 25 can be made of any suitable material which provides frictional resistance to the top. Examples of such materials include resins, polymers, rubbers, etc. The size of the ring is not particularly critical but should be selected to be less than about 80% of the width of the upper case at the point of the recess.

Figure 3B:
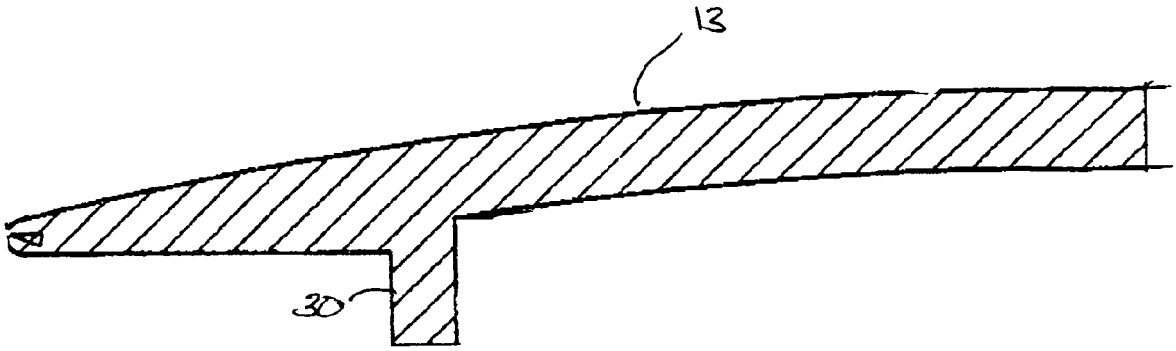
FIGS. 3A and 3B are cross sections of the ornamental top.
Figure 3A:
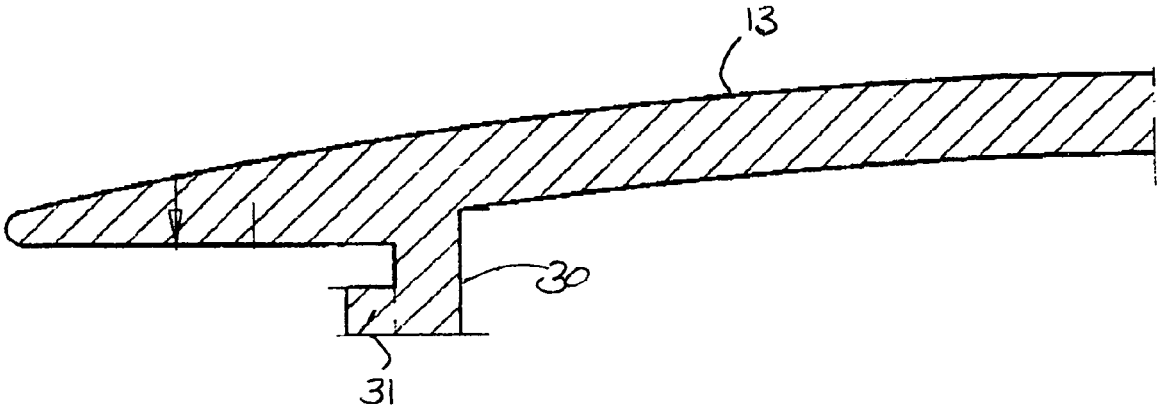

Turning to the ornamental top 13, depicted without its ornament or sculpture, in FIG. 2A with the watchcase and alone in FIG. 3A, the top comprises a flange 30 extending inwardly with respect to said watchcase from the upper surface of the upper case and having at least one bayonette 31, extending further outwardly from said flange 30 and into said track 22 in said upper case. FIGS. 2B and 3B show a cross section of the ornamental top through a section which does not intersect the bayonette. Preferably, the top is characterized by multiple bayonettes, such as two, three or four bayonettes. The bayonettes can be equally spaced around the perimeter of the top or it can be unequally spaced, thereby fixing the orientation of the ornament or sculpture with respect to the watch case.

Figure 4:
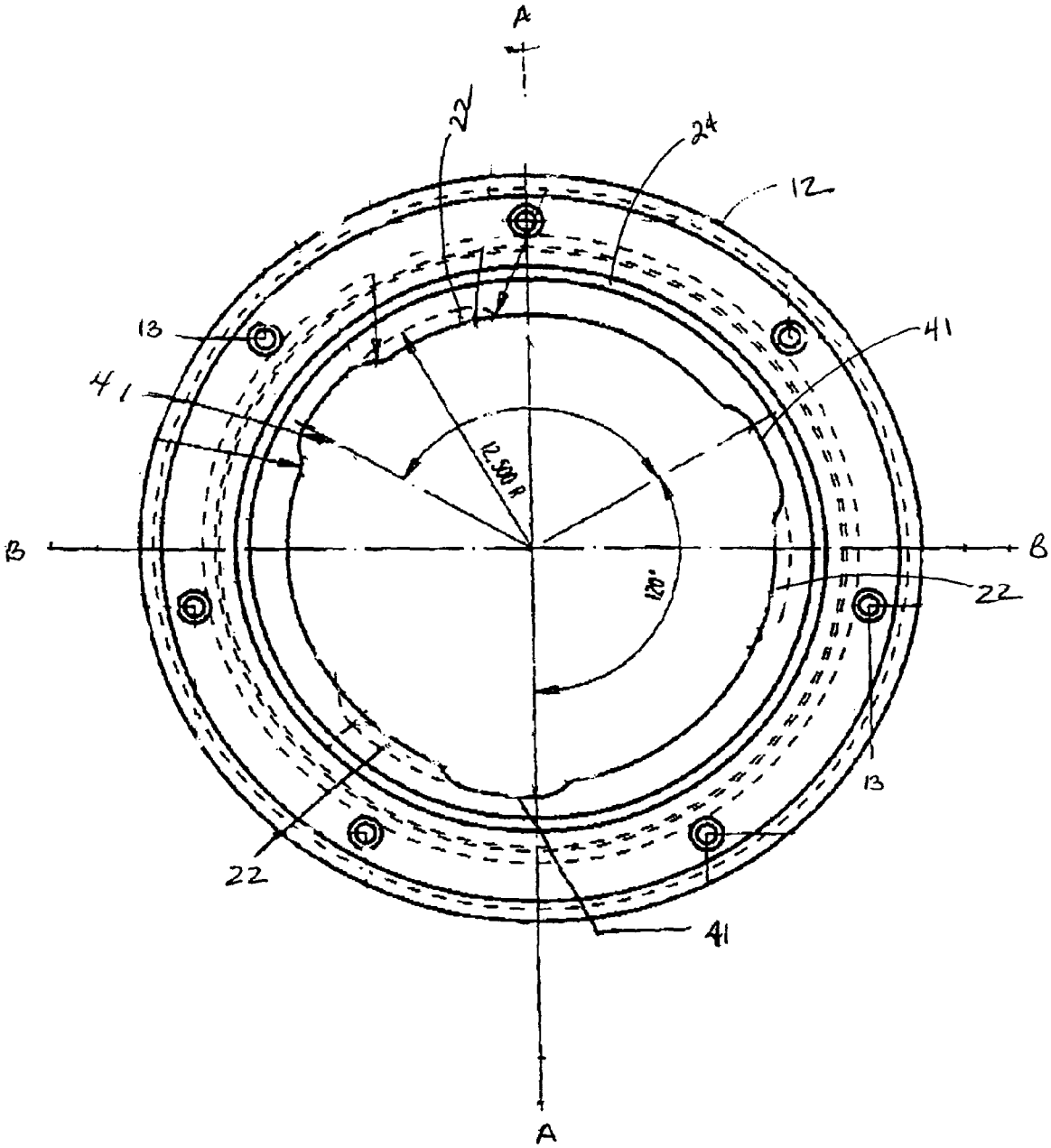
FIG. 4 is a top view of the upper case. Line A—A shows the cross section for FIG. 2A and Line B—B shows the cross section for FIG. 2B.

As discussed above, the upper case of the watchcase is characterized by a track that receives the top. FIG. 4 provides a top view of the upper case 12. The track 22 is shown as being non-contiguous. The track is configured to contain three grooves 41 equally spaced to receive three bayonettes. In this embodiment, the bayonettes span about 15 degrees of the perimeter. Accordingly, the grooves preferably span between 15 and 20 degrees of the perimeter. Of course wider and narrower bayonettes and grooves can be employed. Once the bayonettes are seated into the grooves, the top is rotated to guide the bayonettes along the track 22, which secures the top into place. The dashed line in FIG. 4 depicts the portion of the track that cannot be seen from the top view. The non-contiguous nature of the track defines the extent of travel permitted for the bayonettes. In one embodiment, the bayonettes can travel about 30 degrees around the upper case, permitting substantially complete contact of the bayonettes in the track. In another embodiment, the track prevents bayonette travel for more than 90 degrees, thereby ensuring that, upon rotation, the top is in a secure position.

The top is removably connected to the upper case by seating the top into the upper case and rotating the top so that the track engages the bayonettes of the top. The optional compression ring in the upper case further provides friction which ensures a secure fit. This design affords an easily manipulated removable top with a minimum number of moving parts. The top can be easily removed and changed with a single quick motion with one hand without the need for tools or other removal or attachment aids.

Tops that can be used with the watchcase can be adorned with a large number of ornaments, including sculptures, such as jeweled sculptures or objects d'art. The sculptures can be of varying height from such as sculptures of at least about 1 cm. in height. However, it will be apparent to those skilled in the art that the top may be adorned with substantially flat ornaments as well, such as gems, cloisonné etc. The tops can be sold with the upper case or separately.

While this invention has been particularly shown and described with references to preferred embodiments thereof, it will be understood by those skilled in the art that various changes in form and details may be made therein without departing from the scope of the invention encompassed by the appended claims.

We claim:

1. A watchcase comprising:

(a) a lower case characterized by a first annular recess for receiving an optically transparent cylinder and a timepiece support for receiving a timepiece mechanism;

(b) an upper case characterized by (i) on the bottom surface thereof, a second upper annular recess for receiving an optically transparent cylinder; (ii) on the upper surface thereof, a track for removably receiving and securing an ornamental top and wherein said track in said upper case is characterized by at least one groove for receiving a bayonette;

(c) an optically transparent cylinder placed in said first and second annular recesses and between the lower and upper cases wherein the lower case, upper case and optically transparent cylinder are fixedly connected and (d) a timepiece mechanism attached to said timepiece support comprising a cylindrical band having time increments placed thereon such that the time increments are viewed through the optically transparent cylinder.

2. The watchcase of claim 1 wherein the optically transparent cylinder is a sapphire cylinder.

3. The watchcase of claim 1 wherein the lower case, upper case and optically transparent cylinder are fixedly connected with at least one screw.

4. The watchcase of claim 3 wherein the lower case, upper case and optically transparent cylinder are fixedly connected with a plurality of screws arranged annularly.

5. The watchcase of claim 4 wherein the plurality of screws are arranged annularly within the optically transparent cylinder.

6. The watchcase of claim 4 wherein the plurality of screws are arranged annularly externally of the optically transparent cylinder.

7. The watchcase of claim 4 wherein the plurality of screws are arranged internally of the optically transparent cylinder.

8. The watchcase of claim 1 wherein the track in the upper case is annular and disposed on a plane below the second annular recess.

9. The watchcase of claim 8 further comprising an ornamental top wherein said ornamental top comprises a flange extending inwardly with respect to said watchcase from the upper surface of the upper case and having at least one bayonette extending further outwardly from said flange and wherein said track in said upper case is characterized by at least one groove for receiving each bayonette and, upon rotation of the top with respect to the upper case, engageable with said track.

10. The watchcase of claim 9 wherein said ornamental top comprises at least three bayonettes and said track is characterized by one groove for each bayonette.

11. The watchcase of claim 10 wherein said three bayonettes are equally spaced around the perimeter of the flange.

12. The watchcase of claim 11 wherein the bayonettes span about 15 degrees of the perimeter.

13. The watchcase of claim 12 wherein said grooves for receiving said bayonettes is between about 15 and 20 degrees of the perimeter.

14. The watchcase of claim 13 wherein the bayonettes each rotationally travel along said track for about 30 degrees.

15. The watchcase of claim 14 wherein said track prevents bayonette travel for more than about 90 degrees.

16. The watchcase of claim 15 wherein the upper case, on the upper surface thereof, comprises a third annular recess for receiving a compression ring for frictionally securing said ornamental top thereon.

17. The watchcase of claim 1 wherein said lower case is removably attached to a wristband.

18. The watchcase of claim 1 wherein the outer surface of the lower case is optically transparent to visually expose the timepiece mechanism.

19. The watchcase of claim 1 wherein said track has three grooves equally spaced around the perimeter of the flange.

20. The watchcase of claim 19 wherein said grooves is between about 15 and 20 degrees of the perimeter.

21. The watchcase of claim 1 wherein said track is configured to prevent bayonette travel for more than about 90 degrees.

22. The watchcase of claim 1 wherein the upper case, on the upper surface thereof, comprises a third annular recess for receiving a compression ring for frictionally securing said ornamental top thereon.

* * * * *

UNITED STATES PATENT AND TRADEMARK OFFICE

CERTIFICATE OF CORRECTION

PATENT NO. : 7,281,845 B2
APPLICATION NO. : 10/820641
DATED : October 16, 2007
INVENTOR(S) : Hohenstein et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 362 days.

Signed and Sealed this
Twenty-eighth Day of December, 2010

David J. Kappos

David J. Kappos
*Director of the United States Patent and Trademark Office*